US006254478B1

(12) United States Patent
Namanny et al.

(10) Patent No.: US 6,254,478 B1
(45) Date of Patent: Jul. 3, 2001

(54) COMPETITION INVOLVING SLOTLESS RACE TRACK AND REMOTE CONTROLLED MOTORIZED VEHICLES

(76) Inventors: Keith E. Namanny; Kerry T. Namanny; Kenny D. Namanny, all of 183 N. Main, Cumberland, IA (US) 50843

( * ) Notice: Subject to any disclaimer, the term of this patent is extended or adjusted under 35 U.S.C. 154(b) by 0 days.

(21) Appl. No.: 09/303,747

(22) Filed: May 3, 1999

(51) Int. Cl.[7] ..... A63F 9/24
(52) U.S. Cl. ..... 463/6; 700/91
(58) Field of Search ..... 463/6, 30–32, 463/40, 43, 58; 273/246; 700/91, 92, 93

(56) References Cited

U.S. PATENT DOCUMENTS

| | | | | |
|---|---|---|---|---|
| 4,781,377 | | 11/1988 | McVean et al. | 273/86 R |
| 5,092,605 | | 3/1992 | Hoffman | 273/246 |
| 5,322,293 | | 6/1994 | Goyette | 273/246 |
| 5,372,366 | | 12/1994 | Gohlke | 273/274 |
| 5,439,228 | | 8/1995 | Pedersen | 273/236 |
| 5,603,502 | | 2/1997 | Nahagawa | 273/292 |
| 5,718,429 | | 2/1998 | Heller, Jr. | 273/274 |
| 5,795,226 | | 8/1998 | Yi | 463/22 |
| 5,800,263 | | 9/1998 | Hayashida et al. | 463/6 |
| 5,910,046 | * | 6/1999 | Wada et al. | 463/6 |
| 5,916,024 | * | 6/1999 | Von Kohorn | 463/40 |
| 6,020,851 | * | 2/2000 | Busack | 342/457 |
| 6,053,823 | * | 4/2000 | Mathews | 473/415 |

* cited by examiner

*Primary Examiner*—Michael O'Neill
*Assistant Examiner*—Kim T Nguyen
(74) *Attorney, Agent, or Firm*—James D. Welch

(57) ABSTRACT

Disclosed is a method of conducting a competition utilizing a slotless-micro-race-track system and remote control motorized racing vehicle(s), optionally including the providing of benefits to sponsors in the form of televised presentation of identifying marks during the competition.

30 Claims, 1 Drawing Sheet

COMPETITION INVOLVING SLOTLESS RACE TRACK AND REMOTE CONTROLLED MOTORIZED VEHICLES

TECHNICAL FIELD

The present invention relates to methods of conducting a competition, and in particular is a method of conducting a competition utilizing a slotless-micro-race-track system and remote control motorized racing vehicles.

BACKGROUND

It is known to provide slotless-micro-race-track systems and remote control motorized racing vehicles thereon for the purpose of conducting a competition in which each, (typically a plurality), of the contestants are provided controls for remotely controlling one of such motorized racing vehicles. The competition per se. involves allowing each contestant to remotely control his or her assigned motorized racing vehicle so that it proceeds around the slotless-micro-race-track. Typically a winner of the competition is identified as the contestant who's motorized racing vehicle completes some selected number of laps in a manner judged comparatively superior amongst the contestants, (eg. typically the fastest). It is noted that slotless-micro-race-track systems and remote control motorized racing vehicles appropriate for use in practice of the present invention method, are available from Micro-Reality Motorsports of 183 N. Main, Cumberland, Iowa 50843.

Continuing, it is further noted that businessmen, (eg. potential competition sponsors), are always looking for ways to make the best use of marketing dollars to the end that customers are drawn to their facilities. Thus is identified a potential impetus and need for a method of conducting a competition.

With the foregoing insight, the present invention is disclosed as a method for conducting a competition by a sponsor involving a slotless-micro-race-track system and remote control motorized racing vehicles, which, as a side benefit, might lead to beneficial marketing exposure of said sponsor to a relevant public, which can include a television audience.

With the present invention in mind a Search of Patents was conducted. By far the most relevant Patent found was U.S. Pat. No. 4,781,377 to McVean et al. Said Patent describes a method of conducting a racing event, and a hybrid sporting event and game show based on the sporting event. The sporting event involves mounting robotic jockeys onto live hackney ponies in a racing event made up of one or more races. The robotic jockeys are remote controlled, and players are provided race cards that contain pairings of a race horse identification and an indicium identifying the animal in a corresponding race. Players can win individual races or an entire event depending on the outcome of races and the content of the race cards held, and other factors. Race cards can be distributed in advance of a race event at the race event location, or at a remote location such as supermarkets. The event, said 377 Patent describes, can be broadcast live and winners can be present at a race event or in the broadcast audience.

Another Patent, U.S. Pat. No. 5,32,293 to Goyette, describes a board game with focus on an auto racing game apparatus and method of play. While said 293 Patent identifies the concept of auto racing, it does not suggest application of a slotless race track and remote control motorized racing vehicles. Another such board game having as its focus a method of playing a racing game, is described in U.S. Pat. No. 5,092,605 to Hoffman.

Additional Patents which describe systems and/or methods of playing a game are disclosed because the inventors are aware of them:

U.S. Pat. No. 5,603,502 to Nakagawa;

U.S. Pat. No. 5,800,263 to Hayashida et al.;

U.S. Pat. No. 5,718,429 to Keller Jr.;

U.S. Pat. No. 4,953,873 to Jacobsen;

U.S. Pat. No. 5,795,226 to Yi;

U.S. Pat. No. 5,372,366 to Gohlke; and

U.S. Pat. No. 5,439,228 to Pedersen.

Even in view of the identified known prior art there remains need for a method of conducting a competition utilizing a slotless-race-track system and remote control motorized racing vehicles.

DISCLOSURE OF THE INVENTION

The present invention is a method of conducting a competition which, in preferred practice, involves a sequence of "qualifying" rounds leading-up to a "championship" round. At the first level(s) of rounds sponsors, (who typically want to draw attention to themselves for, perhaps, marketing purposes), will typically provide contestants access to a slotless-micro-racing-track system which comprises remote control motorized racing vehicles and allow said contestants to participate in one or more racing events. Contestants participate by remotely controlling motorized racing vehicles on the slotless-micro-racing-track system. Alternatively, it is noted, preliminary round event winners can be determined by a lottery or drawing or some other means. Winners of preliminary round events then proceed to additional rounds of competition, typically involving other preliminary round event winners, and contestants are hoping to win their way through some number of such preliminary round events and thereby earn the right to participate in a "championship" round. Typically a "championship" round will involve participation in a racing event against a sponsor selected celebrity, (eg. a championship NASCAR race driver), and will be televised.

In one embodiment then, the present invention is a method of conducting a competition by a sponsor which comprises, as a first step, the providing of a slotless-micro-racing-track system. A preferred slotless-micro-racing-track system, it is noted, is available from Micro-Reality Motorsports of 183 N. Main, Cumberland, Iowa 50843, and has a plurality of functionally interconnectable track sections thereby enabling configuration into a variety of continuous shapes. Said shapes can be selected from the group consisting of: (round, oval, tri-oval, "D" shaped, square, rectangular and possibly even an "8" shape), for instance. Said slotless micro-racing-track system further comprises a plurality of remote control racing vehicles, each including a remote control unit for each of said placed remote control motorized racing vehicles. A next step can involve placing such a slotless micro-racing-track system at a sponsor selected location, such as a business location to which is to be attracted patrons, and configuring it into a desired shape by functionally interconnecting sections thereof. This is followed by placing at least one remote control motorized racing vehicle(s) thereon, and placing a remote control unit for each of said placed remote control racing vehicles near-thereby. Said present invention method further comprises selecting a sponsor designated person, defining a criteria for involvement in, and advertising the sponsoring of an event open to persons who meet said criteria, wherein said event comprises a chance to operate a remote control motorized racing vehicle against said sponsor designated person who also operates a remote control motorized racing vehicle, during said event. Said method further involves actually selecting at least one person who meets the defined criteria and selecting a time, and as said event, producing an, optionally televised, show originated at a location selected by the sponsor. Said event optionally comprises locating the slotless-micro-racing-track system at the business location of the sponsor of said event and comprises the staging of a race event between said sponsor designated person and said selected at least one other person. The competition, of course, further involves selecting some criteria as how to determine a winner in said racing event, and conducting said event to the end that a winner is identified.

It is noted that the defining of a criteria and advertising the sponsoring of an event open to persons who meet said criteria, can, though not necessarily, involve requiring patronage at a place of business to which said sponsor wishes to attract patrons, and/or can involve a drawing and/or can involve the staging of a race involving at least two persons appearing at said sponsor's identified location whereat is placed a slotless-micro-racing-track system.

A particularly relevant version of the method of conducting a competition by a sponsor provides that the step of designating a sponsor designated person involve the sponsor designating a person who is a celebrity. Alternatively, said method of conducting a competition by a sponsor can have the same criteria for selecting contestants involvement in a racing event and such could lead to all contestants being non-celebrities.

Said method of conducting a competition by a sponsor can further comprise practicing the steps thereof more than once, to the end that a number of winners are identified. In addition, said method of conducting a competition by a sponsor can further involve developing a new criteria for qualifying said winners to participate in a further competition, said new criteria including having been previously identified as a winner in a prior race event.

A modified version of the present invention method of conducting a competition by a sponsor can again comprise the obtaining a slotless-micro-racing-track system, said slotless-micro-racing-track system having a plurality of functionally interconnectable track sections thereby enabling configuration into a variety of continuous shapes, and further comprising a plurality of remote control motorized racing vehicles, including a remote control unit for each of said placed remote control motorized racing vehicles, and the configuring said slotless-micro-racing-track system into a shapes selected from the group consisting of: (round, oval, tri-oval, "D" shaped, square, rectangular and "8" shaped), for instance. However, said slotless-micro-racing-track system is, in this modified version, placed specifically at a TV station during a racing event. Said modified version of the present invention method involves the selecting of a time, and as said event, producing a televised, (in real-time or delayed), show originated at said TV station, said televised show comprising the staging of a race between said at least two selected persons. (Note that another variation of the present invention method involves time trial events wherein a single contestant is involved and rather than race against other contestant(s), races against time). A winner being selected as the contestant who posts, for instance, the fastest time trial time.

Another recitation of a present method of conducting a competition by a sponsor provides that steps, in any functional order, be practiced, said steps being:

a. providing a race track system with one or more remote control motorized racing vehicles thereon, said remote control motorized vehicles optionally having sponsor identification marking thereon and there being, optionally, sponsor identifying signs placed in the vicinity of said race track system, (ie. near, around and/or on said race track system);

b. selecting at least two contestants selected from the group consisting of:

at least two celebrities;

at least two non-celebrities; and at least a celebrity and a non-celebrity;

c. assigning a remote control motorized racing vehicle to each selected contestant and providing means for remotely controlling it thereto;

d. conducting a televised, real-time or delayed, racing competition amongst said selected contestants;

e. selecting some criteria as how to determine a winner in said event;

to the end that sponsor identifying advertising is observable to television viewers who tune into the telecast, and to the end that a winner of the competition is determined on the basis of the completion of a selected number of laps in a manner judged comparatively superior amongst the contestants.

Said method of conducting a competition by a sponsor can again involve, in the step of providing a race track system with one or more remote control motorized racing vehicles thereon, selecting remote control vehicles shaped as at least one selection from the group consisting of:

car;

truck;

tractor;

sport utility vehicle snowmobile;

go kart;

quadrunnner; and motorcycle;

as well as possibly unusual shapes such as a shoe, as perhaps requested by a sponsor.

It is noted that a preferred version of said method of conducting a competition by a sponsor which comprises the placing of sponsor identifying signs in the vicinity of the race track system in view of the television camera.

Any modification of said method of conducting a competition by a sponsor can further comprise the awarding of prizes to contestants.

A method of conducting a competition by a sponsor can further comprise at least one repeated performance of said method of conducting a competition by a sponsor and wherein the selection criteria for selecting contestants can be varied from what was the initially applied criteria.

It is further noted that another variation of the present invention method involves time trial events wherein a single contestant is involved, and rather than race against other contestant(s), races against time. In such a case a winner is selected on a criteria of, for instance, which contestant posts the fastest time trial time.

It is further to be understood that the step of providing a race track system with at least one remote control motorized racing vehicle(s) thereon can involve providing any functional race track system, (such as demonstrated in the drawings or, for instance, a suitable race track system can be formed by simply drawings lines on an essentially horizontally oriented surface).

It is further to be understood that the step of-assigning a remote control motorized racing vehicle to each selected contestant and providing means for remotely controlling it thereto, call involve ue of any functional remote control system, including counsel and hand-held "means for remotely controlling".

It is further noted that a racing competition amongst selected contestants can be alternatively be referred to as conducting a game show.

It is to be understood that combinations and/or additional variations on the recited present invention method are within the scope thereof.

The system utilized in the practice of the present invention method will be better understood by reference to the Detailed Description Section of this Disclosure, with appropriate reference to the accompanying Drawings.

SUMMARY

It is therefore a primary purpose of the present invention to teach a method of conducting a competition utilizing a slotless-race-track system and remote control motorized racing vehicles.

It is another purpose of the present invention to teach a method of conducting a competition utilizing a slotless-race-track system and remote control motorized racing vehicles, which provides benefits to sponsors in the form of televised presentation of identifying marks.

DETAILED DESCRIPTION

Figure 1:
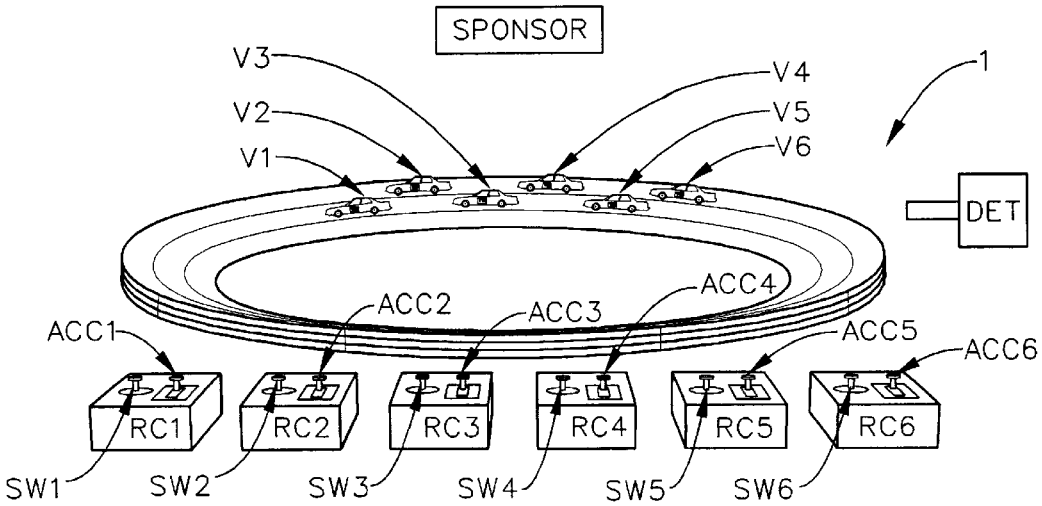
FIG. 1 shows a preferred oval shaped slotless-micro-racing-track system as is available from Micro-Reality Motorsports of 183 N. Main, Cumberland, Iowa 50843.
Figure 5:
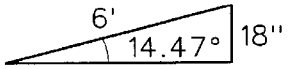
FIG. 5 demonstrates that in side view a slotless-micro-racing-track system section is preferably banked at, a demonstrative and not limiting, approximate fourteen-and-one-half (14.5) degrees.
Figure 6:
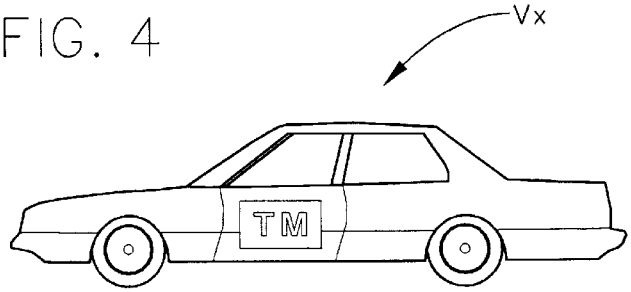
FIG. 6 demonstrate the presence of a trademark (TM) on a motorized racing vehicle.

Turning now to the drawings, in FIG. 1 there is shown a demonstrative, preferred oval shaped slotless-micro-racing-track system (1) as is available from Micro-Reality Motorsports of 183 N. Main, Cumberland, Iowa 50843. FIG. 5 shows that a preferred racing surface of the slotless-micro-racing-track system (1) is banked at an angle of approximately fourteen and one-half (14.5) degrees, with there being an eighteen (18) inch rise over the six foot wide racing surface. Said embankment encourages good motorized racing vehicle traction on the racing surface. It is also to be noted that there is shown a demonstrative sign which can carry the name or trademark or logo etc. of a competition sponsor. As well, contestants can wear clothing with a sponsor's name or trademark or logo etc. of a competition sponsor during a competition. FIG. 6 is included to demonstrate the presence of a sponsor trademark (TM) or other sponsor identifying material on a motorized racing vehicle (VX). As mentioned infra in this Disclosure, a sponsor of racing competitions can gain exposure and benefit from such presence of its identifying marks at a racing competition, particularly where it is televised.

Figure 2:
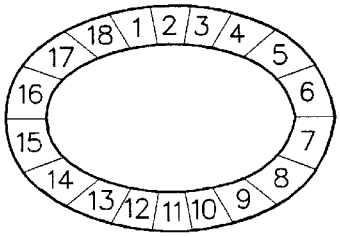
FIGS. 2 and 3 demonstrate oval and circular shaped slotless-micro-racing-track systems constructed from a plurality of functionally interconnectable track sections.
Figure 3:
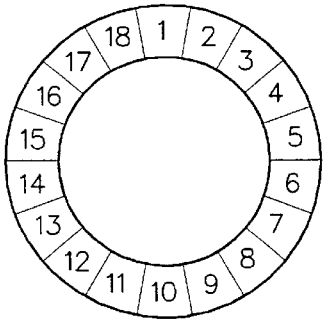

FIG. 2 demonstrates that said preferred oval shaped slotless-micro-racing-track system is constructed from a plurality of functionally interconnectable track sections. Note FIG. 2 could delete straight sections ((2) and (11)). FIG. 3 shows a circular shaped slotless-micro-racing-track system.

Figure 4:
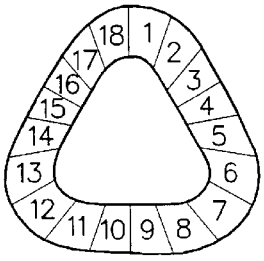
FIG. 4 shows that an alternative configuration can be essentially triangular shaped.

FIG. 4 shows that an alternative configuration can be essentially triangular shaped. Other shapes possible include "D" shaped, square, rectangular.

Continuing, FIG. 1 also shows the presence to motorized racing vehicles (V1), (V2), (V3), (V4), (V5) and (V6) on the racing surface of the preferred oval shaped slotless-micro-racing-track system, as well as the presence of associated Remote Control Systems (RC1), (RC2), (RC3), (RC4), (RC5) and (RC6). It is to be noted that each of the Remote Control Systems as associated therewith a Steering Wheel and Accelerator as follows:

| | | | | | | |
|---|---|---|---|---|---|---|
| REMOTE CONTROL SYSTEM | (RC1) | (RC2) | (RC3) | (RC4) | (RC5) | (RC6) |
| STEERING WHEEL | (SW1) | (SW2) | (SW3) | (SW4) | (SW5) | (SW6) |
| ACCELER-ATOR | (ACC1) | (ACC2) | (ACC3) | (ACC4) | (ACC5) | (ACC6) |

In use, a contestant is provided control over a Racing Vehicle ((V1), (V2), (V3), (V4), (V5), (V6)), associated Remote Control System, (eg. (RC1), (RC2), (RC3), (RC4), (RC5), (RC6)), and operates the associated Steering Wheel ((SW1), (SW2), (SW3), (SW4), (SW5), (SW6)) and Accelerator ((ACC1), (ACC2), (ACC3), (ACC4), (ACC5), (ACC6)), during a competition. Turning Steering Wheel in one direction causes a motorized racing vehicle to turn in one direction, (and vice-versa), and operating an accelerator causes an associated Racing Vehicle to change speed.

For additional insight it is also noted that the motorized racing vehicles utilized in the preferred slotless-micro-racing-track system (1) are approximately twelve (12) to nineteen (19) inches long and five (5) to nine (9) inches wide, and are preferably covered with a removable/replaceable plastic protective covering that serves to prevent damage to the motorized racing vehicles in collisions. In addition this allows easily changing trademark etc. materials visible on said motorized racing vehicles. FIG. 6 is included to demonstrate the presence of a sponsor trademark (TM) on a motorized racing vehicle (VX). As mentioned infra in this Disclosure, a sponsor of racing competitions can gain exposure and benefit from such presence of its identifying marks at a racing competition, particularly where it is televised.

It is further noted that each motorized racing vehicle is equipped with a signal emitting circuit which causes a lap counter detector (DET) to activate every time it makes a lap of the slotless-micro-racing-track. This enables keeping accurate count of laps completed by each racing vehicle as each motorized racing vehicle is caused to emit a different signal.

In addition, it is to be understood that a remote control system can include a robotic drive in a racing vehicle, that there can be a camara mounted in a racing vehicle, that prizes can be awarded to contestants in additional steps of a race event competition, that multiple sponsors can sponsor a rece event competition, and that race event competitions can be televised from a television station or from a remote location.

Finally, it is to be understood that the drawings and discussion in this Disclosure show and describe exemplary, not limiting, slotless-micro-racing-track systems, and that any functionally similar slotless-micro-racing-track systems can be utilized in practice of the present invention methodology, which methodology was disclosed in the Disclosure of the Invention Section of this Disclosure.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the claims.

We claim:

1. A method of conducting a competition by a sponsor or sponsors comprising the steps of:

a. obtaining a slotless micro racing track system, said slotless racing track system having a plurality of functionally interconnectable track sections thereby enabling configuration into at least one continuous shape, said slotless micro racing track system further comprising a plurality of remote control motorized racing vehicles, each including a remote control unit for each of said placed remote control motorized racing vehicles;

in either order performing steps b and c:

b. placing said slotless micro racing track system at a sponsor selected business location to which is to be attracted patrons, and configuring it into a desired shape by functionally interconnecting sections thereof, and further placing a plurality of remote control motorized racing vehicles thereon, and placing a remote control unit for each of said placed remote control motorized racing vehicles near-thereby;

c. selecting sponsor designated person(s), defining a criteria for involvement in, and advertising the sponsoring of an event open to persons who meet said criteria, said event comprising a chance to operate a remote control motorized racing vehicle against said sponsor designated person(s) who also operates a remote control motorized racing vehicle during said event;

and then, in either order, performing steps d and e:

d. selecting at least one person who meets the criteria defined in step c;

e. selecting a time, and as said event, producing an optionally televised show originated at a location selected by the sponsor, said televised show optionally comprising origination at the location of said slotless micro racing track system effected in step b and further comprising the staging of a race between said at least one person selected in step d and said sponsor designated person defined in step c; and f. in functional combination with steps a–e selecting some criteria as how to determine a winner in said event;

and conducting said event to the end that a winner is identified.

2. A method of conducting a competition by a sponsor or sponsors as in claim 1, in which the step of placing said slotless micro racing track system at a sponsor selected location whereat a sponsor desires to attract patrons, involves selecting a place of business to which said sponsor wishes to attract patrons.

3. A method of conducting a competition by a sponsor or sponsors as in claim 2, in which the step of defining a criteria and advertising the sponsoring of an event open to persons who meet said criteria, involves defining a criteria based upon patronage at said a place of business to which said sponsor wishes to attract patrons.

4. A method of conducting a competition by a sponsor or sponsors as in claim 1, in which the step of designating a sponsor designated person involves the sponsor designating a person who is a celebrity.

5. A method of conducting a competition by a sponsor or sponsors as in claim 1, in which the step of designating a sponsor designated person involves the sponsor designating a person who is identified by a person who is afforded a chance to operate a remote control motorized racing vehicle against.

6. A method of conducting a competition by a sponsor or sponsors as in claim 1, in which the step of configuring said slotless micro racing track into a desired shape by functionally interconnecting sections thereof involves causing said track to assume a shape selected from the group consisting of:

round, oval, tri-oval, D-shaped, square, rectangular and 8-shaped.

7. A method of conducting a competition by a sponsor or sponsors as in claim 1, which further comprises practicing the steps thereof more than once to the end that a number of winners are identified, and defining a new criteria which qualifies said winners to participate in a further competition, said new criteria including having been previously identified as a winner.

8. A method of conducting a competition by a sponsor or sponsors comprising the steps of:

a. obtaining a slotless micro racing track system, said slotless racing track system having a plurality of functionally interconnectable track sections thereby enabling configuration into at least one continuous shape, said slotless micro racing track system further comprising a plurality of remote control motorized racing vehicle, each including a remote control unit for each of said placed remote control motorized racing vehicles;

b. placing said slotless micro racing track system at a TV station and configuring it into a desired shape by functionally interconnecting sections thereof, and further placing a plurality of remote control motorized racing vehicles thereon, and placing a remote control unit for each of said placed remote control motorized racing vehicles near-thereby;

c. optionally placing a slotless micro racing track system at a sponsor's place of business and configuring it into a desired shape by functionally interconnecting sections thereof, and further placing a plurality of remote control motorized racing vehicles thereon, and placing a remote control unit for each of said placed remote control motorized racing vehicles near-thereby;

d. selecting sponsor designated person(s), defining a criteria and advertising the sponsoring of an event open to persons who meet said criteria, said event comprising a chance to operate a remote control motorized racing vehicle against said sponsor designated person(s) who also operates a remote control motorized racing vehicle during said event, said criteria including appearing at a sponsor's place of business and said criteria further including a selected from the group consisting of:

a drawing, and staging of a race involving at least two persons appearing at said sponsor's place of business whereat was placed a slotless micro racing track system in step c;

in either order performing steps e and f:

e. selecting at least one person who meets the criteria defined in step d;

f. selecting a time, and as said event, producing a televised show originated at said TV station, said televised show comprising the staging of a race between said at least one person selected in step e and said sponsor designated person; and g. in functional combination with steps a–f selecting some criteria as how to determine a winner in said event;

and conducting said event to the end that a winner is identified.

9. A method of conducting a competition by a sponsor or sponsors comprising the steps of:

a. providing a race track system with at least one remote control motorized racing vehicle or vehicles thereon, said remote control motorized racing vehicle or vehicles optionally having sponsor identification marking thereon and there being, optionally, sponsor identifying signs placed in the vicinity of said race track system;

in either order performing steps b and c:

b. selecting at least one celebrity contestant;

c. selecting at least one non-celebrity contestant;

and then proceeding to perform steps d and e:

d. assigning a remote control motorized racing vehicle to each selected contestant and providing means for remotely controlling it thereto;

e. conducting a televised, real-time or delayed, racing competition amongst said selected contestants; and f. in functional combination with steps b–e selecting some criteria as how to determine a winner in said competition;

to the end that sponsor identifying advertising is observable to television viewers who tune into the telecast, and to the end that a winner of the competition is determined on the basis of the criteria selected in step f.

10. A method of conducting a competition by a sponsor or sponsors as in claim 9 in which the step of providing a race track system with at least one remote control motorized racing vehicle or vehicles thereon involves selecting remote control vehicle or vehicles shaped as at least one selection from the group consisting of:

car;
truck;
tractor;
sport utility vehicle
snowmobile;
go kart;
quadrunner; and
motorcycle.

11. A method of conducting a competition by a sponsor or sponsors as in claim 9 which does comprise the placing of sponsor identifying signs in the vicinity of the race track system in view of the television camera.

12. A method of conducting a competition by a sponsor or sponsors as in claim 9 which further comprises the awarding of prizes to contestants.

13. A method of conducting a competition by a sponsor or sponsors as in claim 9 which further comprises at least one repeated performance of said method of conducting a competition by a sponsor and wherein the selecting at least one celebrity contestant, and the selecting at least one non-celebrity contestant does not necessarily involve the same at least one celebrity contestant, and the same at least one non-celebrity contestant.

14. A method of conducting a competition by a sponsor or sponsors comprising the steps of:

a. providing a race track system with at least one remote control motorized racing vehicle or vehicles thereon, said remote control motorized racing vehicle or vehicles optionally having sponsor identification marking thereon and there being, optionally, sponsor identifying signs placed in the vicinity of said race track system;

b. selecting at least two celebrity contestants;

c. assigning a remote control motorized racing vehicle to each selected contestant and providing means for remotely controlling it thereto;

d. conducting a televised, real-time or delayed, racing competition amongst said selected contestants;

e. in functional combination with steps a–e selecting some criteria as how to determine a winner in said competition;

to the end that sponsor identifying advertising is observable to television viewers who tune into the telecast, and to the end that a winner of the competition is determined on the basis of the criteria selected in step e.

15. A method of conducting a competition by a sponsor or sponsors as in claim 14 in which the step of providing a race track system with at least one remote control motorized racing vehicle or vehicles thereon involves selecting remote control vehicle or vehicles shaped as at least one selection from the group consisting of:

car;
truck;
tractor;
sport utility vehicle
snowmobile;
go kart;
quadrunner; and
motorcycle.

16. A method of conducting a competition by a sponsor or sponsors as in claim 14 which does comprise the placing of sponsor identifying signs in the vicinity of the race track system in view of the television camera.

17. A method of conducting a competition by a sponsor or sponsors as in claim 14 which further comprises the awarding of prizes to contestants.

18. A method of conducting a competition by a sponsor or sponsors as in claim 14 which further comprises at least one repeated performance of said method of conducting a competition by a sponsor and wherein the selecting at least one celebrity contestant, and the selecting at least one non-celebrity contestant does not necessarily involve the same at least one celebrity contestant, and the same at least one non-celebrity contestant.

19. A method of conducting a competition by a sponsor or sponsors comprising the steps of:

a. providing a race track system with at least one remote control motorized racing vehicle or vehicles thereon, said remote control motorized racing vehicle or vehicles optionally having sponsor identification marking thereon and there being, optionally, sponsor identifying signs placed in the vicinity of said race track system;

b. selecting at least two non-celebrity contestants;

c. assigning a remote control motorized racing vehicle to each selected contestant and providing means for remotely controlling it thereto;

d. conducting a televised, real-time or delayed, racing competition amongst said selected contestants;

e. in functional combination with steps a–d selecting some criteria as how to determine a winner in said competition;

to the end that sponsor identifying advertising is observable to television viewers who tune into the telecast, and to the end that a winner of the competition is determined on the basis of the criteria selected in step e.

20. A method of conducting a competition by a sponsor or sponsors as in claim 19 in which the step of providing a race track system with at least one remote control motorized racing vehicle or vehicles thereon involves selecting remote control vehicle or vehicles shaped as at least one selection from the group consisting of:

car;

truck;

tractor;

sport utility vehicle snowmobile;

go kart;

quadrunner; and motorcycle.

21. A method of conducting a competition by a sponsor or sponsors as in claim 19 which does comprise the placing of sponsor identifying signs in the vicinity of the race track system in view of the television camera.

22. A method of conducting a competition by a sponsor or sponsors as in claim 19 which further comprises the awarding of prizes to contestants.

23. A method of conducting a competition by a sponsor or sponsors as in claim 19 which further comprises at least one repeated performance of said method of conducting a competition by a sponsor and wherein the selecting at least one celebrity contestant, and the selecting at least one non-celebrity contestant does not necessarily involve the same at least one celebrity contestant, and the same at least one non-celebrity contestant.

24. A method of conducting a competition by a sponsor or sponsors comprising the steps of:

a. providing a race track system with at least one remote control motorized racing vehicle or vehicles thereon, said remote control motorized racing vehicle or vehicles optionally having sponsor identification marking thereon and there being, optionally, sponsor identifying signs placed in the vicinity of said race track system;

b. selecting one contestant;

c. assigning a remote control motorized racing vehicle to said selected contestant and providing means for remotely controlling it thereto;

d. conducting a televised, real-time or delayed, time trial competition;

e. repeating steps a–d some selected number of times with a different contestant being selected in at least one said repeat;

f. in functional combination with steps a–e selecting some criteria as how to determine a winner in said competition;

to the end that sponsor identifying advertising is observable to television viewers who tune into the telecast, and to the end that a winner of the competition is determined on the basis of the criteria selected in step f.

25. A method of conducting a competition by a sponsor or sponsors as in claim 1, which further comprises the placing of a camera in a racing vehicle.

26. A method of conducting a competition by a sponsor or sponsors as in claim 8, which further comprises the placing of a camera in a racing vehicle.

27. A method of conducting a competition by a sponsor or sponsors as in claim 9, which further comprises the placing of a camera in a racing vehicle.

28. A method of conducting a competition by a sponsor or sponsors as in claim 14, which further comprises the placing of a camera in a racing vehicle.

29. A method of conducting a competition by a sponsor or sponsors as in claim 19, which further comprises the placing of a camera in a racing vehicle.

30. A method of conducting a competition by a sponsor or sponsors as in claim 24, which further comprises the placing of a camera in a racing vehicle.

* * * * *